US008203283B2

(12) United States Patent
Hoogzaad

(10) Patent No.: US 8,203,283 B2
(45) Date of Patent: Jun. 19, 2012

(54) LIGHT EMITTING DIODE (LED) ARRANGEMENT WITH BYPASS DRIVING

(75) Inventor: Gian Hoogzaad, Mook (NL)

(73) Assignee: NXP B.V., Eindhoven (NL)

( * ) Notice: Subject to any disclaimer, the term of this patent is extended or adjusted under 35 U.S.C. 154(b) by 274 days.

(21) Appl. No.: 12/669,384

(22) PCT Filed: Jul. 16, 2008

(86) PCT No.: PCT/IB2008/052864

§ 371 (c)(1),
(2), (4) Date: Jan. 15, 2010

(87) PCT Pub. No.: WO2009/013676

PCT Pub. Date: Jan. 29, 2009

(65) Prior Publication Data

US 2010/0194274 A1 Aug. 5, 2010

(30) Foreign Application Priority Data

Jul. 23, 2007 (EP) ..... 07112960

(51) Int. Cl.
*G05F 1/00* (2006.01)

(52) U.S. Cl. ..... 315/291; 315/294; 315/312; 315/320; 315/188; 315/185 R; 362/613; 362/631

(58) Field of Classification Search .... 315/169.1–169.3, 315/291, 294, 312, 315, 320, 185 R, 188, 315/192; 345/46, 82, 102, 212, 690, 691; 362/27, 611–613, 555, 631
See application file for complete search history.

(56) References Cited

U.S. PATENT DOCUMENTS

| | | | | |
|---|---|---|---|---|
| 5,959,413 | A | 9/1999 | Komarek et al. | |
| 6,188,420 | B1 * | 2/2001 | Kuribayashi et al. | 347/132 |
| 6,876,008 | B2 * | 4/2005 | Bhat et al. | 257/99 |
| 7,633,463 | B2 * | 12/2009 | Negru | 345/46 |
| 7,728,798 | B2 * | 6/2010 | Kim | 345/82 |
| 7,800,316 | B2 * | 9/2010 | Haug | 315/299 |
| 7,986,107 | B2 * | 7/2011 | Weaver et al. | 315/291 |
| 7,994,723 | B2 * | 8/2011 | Budde et al. | 315/90 |
| 2004/0145320 | A1 | 7/2004 | Nijhof et al. | |
| 2005/0218838 | A1 | 10/2005 | Lys | |
| 2005/0243022 | A1 | 11/2005 | Negru | |
| 2006/0261752 | A1 | 11/2006 | Lee | |
| 2006/0261754 | A1 | 11/2006 | Lee | |
| 2010/0315016 | A1 * | 12/2010 | Hoogzaad | 315/224 |
| 2011/0025230 | A1 * | 2/2011 | Schulz et al. | 315/294 |
| 2011/0068702 | A1 * | 3/2011 | van de Ven et al. | 315/186 |
| 2011/0068713 | A1 * | 3/2011 | Hoogzaad et al. | 315/307 |

FOREIGN PATENT DOCUMENTS

| | | | |
|---|---|---|---|
| DE | 10358447 | B3 | 5/2005 |
| JP | 2006012632 | A | 1/2006 |
| WO | 2004100614 | A1 | 11/2004 |
| WO | 2007/069200 | A | 6/2007 |

* cited by examiner

*Primary Examiner* — Haiss Philogene

(57) ABSTRACT

The invention provides a LED arrangement including a LED string of a series arrangement of LED segments. A LED segment includes a single LED or a series arrangement of LEDs. A switching element (12, 22) is arranged in parallel with each corresponding LED segment (10, 20) of the LED string, for controlling a current (52, 62) through the LED segment (10, 20). A capacitor (13, 23) is arranged in parallel with each corresponding LED segment (10, 20) in order to prevent the occurrence of possibly harmful current spikes while switching one or more LED segments. The LED arrangement may also include a switched-mode power supply (2001). The invention further provides a LED assembly. A plurality of such LED assemblies assembles easily into a LED arrangement according to the invention.

16 Claims, 14 Drawing Sheets

Prior art

Prior art

LIGHT EMITTING DIODE (LED) ARRANGEMENT WITH BYPASS DRIVING

FIELD OF THE INVENTION

The invention relates to a light emitting diode (LED) arrangement. The invention further relates to a LED assembly. The invention further relates to an illumination system.

BACKGROUND OF THE INVENTION

Such a LED arrangement is known from U.S. Pat. No. 5,959,413. U.S. Pat. No. 5,959,413 discloses a driving circuit in which each LED has a controllable logic switch in parallel across it and the switches are further in series circuit with each other to form a ladder network. Any selected LED may be switched off by closing its corresponding switch. The current continues to flow then through the shunting switch into the remaining LEDs in the series circuit that are on. A plurality of such ladder networks may be coupled in parallel with each other and each ladder network may be controlled by a switching gate which selectively couples it to the constant current source so that the LED ladder networks are operated at a predetermined duty cycle. Current spikes are avoided across the voltage supply by driving the connecting control gates of the parallel strings in an overlapping relationship so that the constant current source is never disconnected from the voltage supply.

The known circuit has the disadvantage that it is required to be controlled in such a way that always a LED is driven to prevent current spikes in the power supply line. Hence it is needed to use an overlapping driving scheme for the parallel strings and it is needed to distribute all LEDs over a plurality of strings if a low duty cycle is required. This adversely limits the range of duty cycles that can be used when operating the LEDs.

An alternative arrangement is known from US patent application US2005/0243022 A1. An efficient power supply in the form of a switched-mode power supply is provided in FIGS. 6 and 7 of US2005/0243022 A1. The switched-mode power supply uses a switch, a coil and a diode, where the switch is operated to charge the coil, which is discharged via the diode. In such an arrangement, the current shows a large ripple, i.e., it fluctuates with a large amplitude around an average level. A known solution to limit this ripple to a relatively small amplitude is to place a filter capacitor over the output of switch mode supply. A disadvantage of this approach is that current spikes occur when the load on the switch mode is changing, as a result of switching LEDs on and off in the series arrangement. The current spikes can damage the LEDs as well as the power supply.

SUMMARY OF THE INVENTION

The present invention aims to provide a LED arrangement comprising a LED string and a driver circuit arrangement which can accommodate a wide range of duty cycles for driving each individual LED or each individual segment of several LEDs with bypass switches without the occurrence of current spikes, which could damage the LEDs. The invention further aims to provide a LED assembly to be applied in such a LED arrangement.

Hereto the LED arrangement according to the present invention comprises a LED string and a driver circuit arrangement. The LED string comprises at least two LED segments, the at least two LED segments being arranged electrically in series. Each LED segment comprises at least one LED. The driver circuit arrangement comprises a segment driver unit for each of the at least two LED segments. Each segment driver unit comprises a first switching element arranged electrically parallel with a corresponding LED segment for controlling, during use, of a current through the LED segment. Each segment driver unit further comprises a first capacitor, the first capacitor being arranged electrically in parallel with at least one of the LEDs of the corresponding LED segment.

These segmented capacitors prevent the occurrence of high transient current peaks, which could otherwise occur in the LED string when switching one of the LED segments, in particular in the LED segments that are not switched while another segment of the LED string is switched. These high transient current peaks could severely damage the LEDs. By placing a capacitor in parallel to at least one of the LEDs of each LED segment instead of placing a single capacitor parallel to the supply, these high transient current peaks are prevented. The lifetime of the LEDs is thus significantly improved.

Usually, the capacitor is placed in parallel to the complete LED segment. This is however not necessary. It is not excluded that also the power to the driver of the bypass-switch is provided along the LED string, and thus via the first capacitor. The voltage over the series-connected LEDs in the LED segment may be too high in order to power the driver. This problem is then solved in that the power is then drawn from a node between two LEDs within the LED segment. As a consequence, the first capacitor will be placed in parallel only to some of the LEDs instead of all LEDs in the LED segment. Drawing the power for the driver from the LED string is considered advantageous in order to simplify the overall architecture: additional power source lines and voltage regulators are not required. Moreover, the resulting driver arrangement can therewith be split into segments corresponding to the LED segments. Such a modular construction of the arrangement allows flexibility in applications. That is often beneficial in lighting applications, which include more often than not a large area. The power can for instance be drawn from the LED string with a gating element between the node and the first capacitor. Such a gating element is for instance a diode or a sample switch with a sample driver coupled thereto. It is observed for clarity that this modular architecture of the driving arrangement does not require that the power is drawn between a first and a second LED in the LED segment.

In one embodiment of the invention, the driver circuit arrangement comprises a segment controller. The segment controller is arranged for generating a first control signal for each segment driver unit, in order to drive the first switching element of the corresponding segment driver unit. The segment controller is arranged for executing a drive period, and repeating the drive period periodically. The drive period comprises at least three subsequent phases. The segment controller is further arranged for: in the first phase, closing the first switching element such that the current through the LED segment stops and the LED segment is switched off; in the second phase, keeping the first switching element closed for a specific duration of time for each individual drive period; in the third phase, opening the first switching element such that the current flows through the LED segment and the LED segment is switched on.

The segment controller thus operates the segment driver units as to generate a required amount of light, by adapting the duty cycle of the LEDs to achieve a required amount of light averaged over the drive period.

In a further embodiment of the invention, the segment controller is arranged for applying a timing compensation to the specific duration for each individual drive period, the timing compensation compensating for the switching delay of the corresponding segment driver unit.

This provides a method to compensate for the switch-on delay that may occur especially when the segment driver unit does not comprise the sample-and-hold switch in series with the first capacitor (as in an embodiment described below).

In a further embodiment of the invention, each segment driver unit comprises a second switching element, the second switching element being arranged electrically in series with the first capacitor.

The series arrangement of the first capacitor and the second switching element is thus electrically parallel with the LED segment. This second switching element is used as a sample-and-hold switch, and is operated so as to set (sample) and keep (hold) the LED operating voltage on the first capacitor while the LED is not operated, i.e., when the bypass switch is closed. As a result, there is no need to first load the capacitor when switching on of the LED upon closing the bypass switch, and the switching on of the LED can occur without any switch-on delay. Moreover, the capacitive losses that would be associated with charging and discharging the first capacitor are prevented. As a result, an efficient operation can be achieved.

In another further embodiment, the segment controller described above is further arranged for generating a second control signal for each segment driver unit, in order to drive the second switching element of the corresponding segment driver unit. The drive period comprises the at least three phases and a further first auxiliary phase prior to the first phase and a second auxiliary phase after the third phase. The segment controller is further arranged for: in the first auxiliary phase, opening the second switching element such that the voltage over the corresponding LED segment is held by the first capacitor; in the first phase, closing the first switching element such that the current through the LED segment stops and the LED segment is switched off; in the second phase, keeping the first switching element closed for a specific duration of time for each individual drive unit; in the third phase, opening the first switching element such that the current flows through the LED segment and the LED segment is switched on, and in the second auxiliary phase, closing the second switching element.

The segment controller thus operates the segment driver units so as to generate a required amount of light, by adapting the duty cycle of the LEDs to achieve a required amount of light averaged over the drive period. The second switching element and the first capacitor are operated such as to hold the voltage across the LED for a next switching-on phase after the LED has been switched off. As a result, the switching on delay is reduced to essentially zero and a fast rise-time results when switching on the LED. Moreover, the timing of the activation and deactivation of the second switching elements is executed so as to prevent a short-circuit of the first capacitor and second switching element by this so-called non-overlapping clocking scheme.

In a further embodiment of the invention, the segment driver unit comprises a second capacitor, the second capacitor being arranged electrically in parallel with the corresponding LED segment.

This arrangement prevents possible problems while the first capacitor is disconnected and the LED current is only filtered by the parasitic capacitance of the LED itself, and thus relaxes the timing tolerances of the segment driver.

In an embodiment, the LED arrangement further comprises a power supply arranged for energizing the LED string.

During use, the power supply is arranged for supplying a supply current to the LED string which is substantially independent of the number of LEDs that are on and off at any moment in time. This way, the LEDs are always driven with a well-defined current, such that a stable output is achieved.

In a preferred embodiment, the power supply comprises a switched-mode controller, a third switching element, an inductive element and a component selected from the group of a diode and a fourth switching element, wherein the switched-mode controller is arranged for operating the third switching element in order to charge and discharge the inductive element, wherein the inductive element is discharged via the component selected from the group of a diode and a fourth switching element.

With these components, a so-called switch-mode DC/DC converter may be constructed which adjusts the effective voltage at its output terminal to the exact voltage needed by the driven system. This results in a very effective power conversion from a wide range of input voltages.

In a preferred embodiment, the power supply is one selected from the group of a so-called Buck converter and a so-called Buck-boost converter. A Buck converter is a converter topology which can adjust its output voltage to any voltage below the input voltage. A Buck-boost converter is a converter topology which can adjust its output voltage below the input voltage as well as above the input voltage. When the LED string comprises a large number of LED segments, the voltage across the LED string can vary strongly depending on the number of LED segments that are switched on and the number of LED segments that are switched off because their bypass switches are closed. With an input voltage corresponding to the voltage over the LEDs when all LEDs would be on, the Buck converter topology adapts its output voltage to provide the required supply voltage to the LED string. The Buck-boost topology provides the required high supply voltage when all LEDs are on with, e.g., a voltage above the input voltage, and will also supply the required low supply voltage when all LEDs are off and a voltage below the input voltage is required.

A LED assembly according to the present invention comprises at least one LED die and a first capacitor, the first capacitor being arranged electrically in parallel to the at least one LED die.

A multiplicity of such LED assemblies can easily be assembled into a LED arrangement of any of the embodiments described above. It reduces the number of components, and moreover allows easy scalability of the LED arrangement when one or more LED segments need to be added or removed.

Alternatively, a plurality of these assemblies can be put together to form a ladder network of LEDs and capacitors. This ladder network may then be connected to a plurality of external switches to create a LED arrangement according to the invention. Preferably, the light emitting diode (LED) assembly further comprises a carrier to carry the at least one LED die and the first capacitor.

The scalability can be achieved with very small units, by having the capacitor and the LED die carried by a submount. The submount can be a silicon or a ceramic carrier, and the capacitor can be mounted on one of its surfaces or integrated in the submount itself. Alternatively, the carrier can be a printed circuit board (PCB) of, e.g., a larger size. Such a PCB may be a LED module of several LED segments with their associated segment unit drivers, such that arrangements of a large size can be made with easy-to-handle modules. In a further embodiment, the LED assembly comprises also a sample-and-hold switching element, wherein the carrier carries the sample-and-hold switching element, the sample-and-hold switching element being arranged electrically in series with the first capacitor.

This allows easy assembly of further embodiments of the LED arrangement as described above.

Alternatively or additionally, the LED assembly may comprise a second capacitor, wherein the carrier carries the second capacitor, and the second capacitor is arranged electrically in parallel to the at least one LED die.

This capacitor prevents possible problems while the first capacitor is disconnected and the LED current is only filtered by the capacitance of the LED itself, and thus relaxes the timing tolerances of the segment driver.

Alternatively or additionally, the LED assembly may comprise a bypass switching element, wherein the carrier carries the bypass switching element, and the bypass switching element is arranged electrically in parallel to the at least one LED die.

This allows integrating also the bypass switching element itself in the LED assembly, thus providing a highly integrated and self-contained segment module containing the LED segment as well as its associated segmented capacitor and its associated bypass switch and associated bypass switch driver electronics.

In a further embodiment, a LED arrangement as described above may be constructed from at least two LED assemblies as described above. The LED arrangement may comprise a power supply.

A further embodiment of the invention relates to an illumination system comprising one of the LED assemblies described above.

This may be a brightness controlled LED-lamp, a color-variable LED lamp, a LED matrix light source, a LED matrix display, a large-sized LED information display for advertisement or moving images, a LED-backlight for a LCD-TV, a LED-backlight for a LCD-monitor, or any other lighting system with at least two LED segments operated with bypass switches.

A further embodiment of the invention relates to a method for controlling a

LED arrangement according to the invention. Preferably the method comprises:

generating a first control for each segment driver unit, the first control signal driving the first switching element of the corresponding segment driver unit, executing a drive period, and repeating the drive period periodically, each drive period comprising at least three subsequent phases; the method comprising:

in the first phase, closing the first switching element such that the current through the LED segment stops and the LED segment is switched off, in the second phase, keeping the first switching element closed for a specific duration of time for each individual drive period, in the third phase, opening the first switching element such that the current flows through the LED segment and the LED segment is switched on.

The method thus operates the LED arrangement as to generate a required amount of light, by adapting the duty cycle of the LEDs to achieve a required amount of light averaged over the drive period.

In a further embodiment, the method further comprises:

applying a compensation to the specific duration time for each individual drive period, the compensation compensating for the switching delay of the corresponding segment driver unit.

This provides a method to compensate for the switch-on delay that may occur especially when the segment driver unit does not comprise the sample-and-hold switch in series with the first capacitor.

In an alternative further embodiment, the method further comprises:

generating a second control signal for each segment driver unit, the second control signal driving a second switching element of the corresponding segment driver unit, the drive period comprising a first auxiliary phase prior to the first phase and a second auxiliary phase after the third phase, in the first auxiliary phase, opening the second switching element such that the voltage over the corresponding LED segment is held by the first capacitor, in the first phase, closing the first switching element such that the current through the LED segment stops and the LED segment is switched off, in the second phase, keeping the first switching element closed for a specific duration of time, in the third phase, opening the first switching element such that the current flows through the LED segment and the LED segment is switched on, in the second auxiliary phase, closing the second switching element.

The method thus operates the LED arrangement as to generate a required amount of light, by adapting the duty cycle of the LEDs with the first switching elements to achieve a required amount of light averaged over the drive period. The second switching element and the first capacitor are operated such as to hold the voltage across the LED for a next switching-on phase after the LED has been switched off. As a result, the switch-on delay is reduced to essentially zero and a fast rise-time results when switching on the LED.

Moreover, the timing of the activation and deactivation of the second switching elements is executed so as to prevent a short-circuit of the first capacitor and second switching element by this so-called non-overlapping clocking scheme.

BRIEF DESCRIPTION OF DRAWINGS

The above and other aspects of the invention will be further elucidated and described in detail with reference to the drawings, in which corresponding reference symbols indicate corresponding parts.

DETAILED DESCRIPTION OF EMBODIMENTS

Figure 1A:
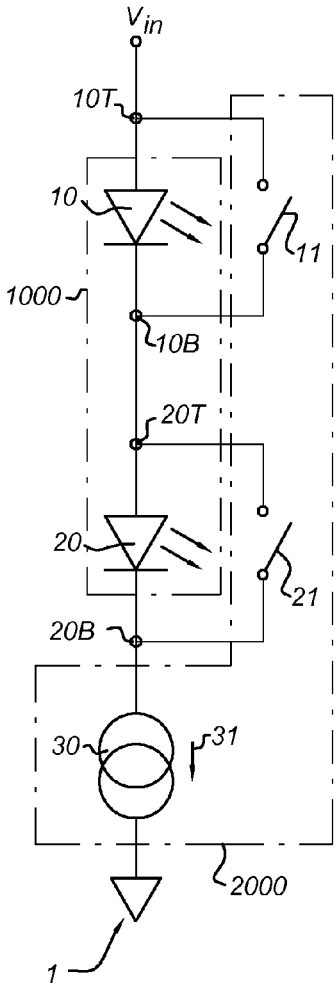
FIG. 1*a* shows a LED arrangement comprising a LED string and a driver circuit arrangement according to the prior art.
Figure 1B:
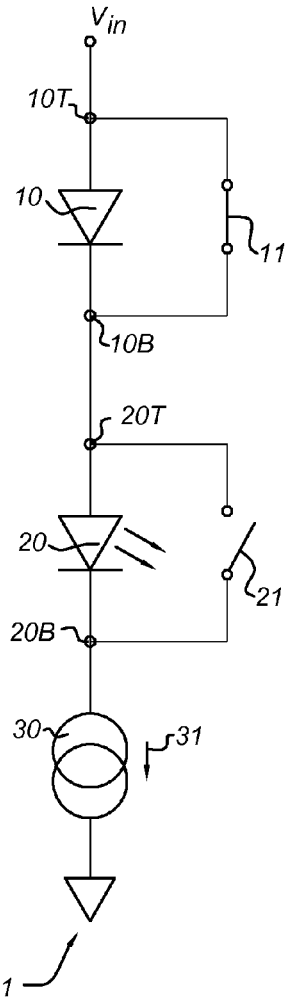
Prior art Fig 1b
FIG. 1*b* shows again the LED arrangement comprising a LED string and a driver circuit arrangement according to the prior art.

FIG. 1*a* shows a number of LEDs 10, 20 arranged electrically in series forming a LED string 1000. The LED string is equipped with a driver circuit 2000. The driver circuit comprises a current source 30 which supplies a current 31, electrical switches 11, 21 and nodes 10T, 10B, 20T and 20B. The switches 11, 21 are each arranged electrically parallel with a LED 10, 20. The switch 11 connects between node 10T and 10B on either side of LED 10. Likewise, the switch 21 connects between node 20T and 20B on either side of LED 20. When the switches 11, 21 are open, the current 31 flows through the LEDs 10, 20, causing the LEDs to emit light, as shown in FIG 1*a*. FIG. 1*b* shows the same arrangement, but with the top switch 11 closed. This gives a lower-resistive current path through the top switch 11 as through the top LED 10, causing the current to flow through the top switch 11 instead of the top LED 10, and thus causing the top LED 10 to switch off. The current is thus bypassing the LED 10. In FIG. 1*b*, the lower switch 21 is still open, such that the lower LED 20 is still on. By operating the switches 11, 21, the duty cycle at which the corresponding LEDs 10, 20 are switched on is controlled. During this operation, the current source 30 is arranged to keep its output current 31 substantially constant at a fixed level.

Figure 2:
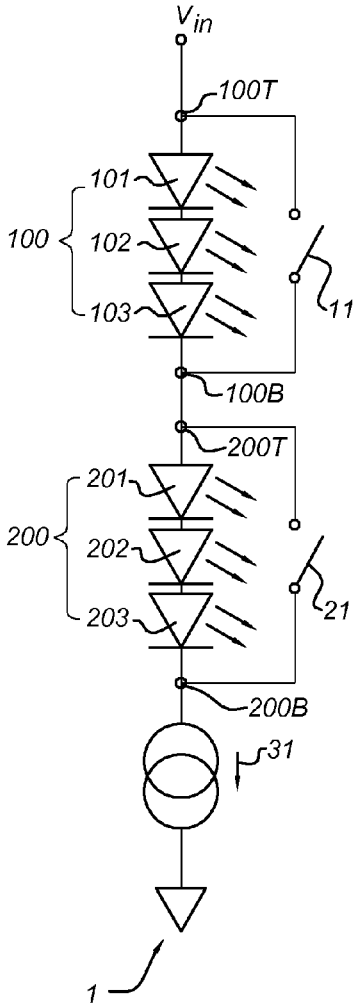
Prior art Fig 2
FIG. 2 shows another LED arrangement comprising a LED string and a driver circuit arrangement according to the prior art.

FIG. 2 shows an alternative arrangement with a longer string of LEDs. The LEDs 101, 102, 103 are grouped in a LED segment 100, all LEDs being arranged in series. The bypass switch 11 is arranged electrically parallel to the whole LED segment 100, instead of to a single LED, and connects between node 100T and 100B of LED segment 100. The LED segment 100 is electrically in series with a second LED segment 200, of LEDs 201, 202, 203 in series, together forming the LED string. The operation is similar as that of FIG. 1*a* and FIG. 1*b*. In the example shown, the LED segment 100 consists of three LEDs 101, 102, 103 in series, but it can of course also have any other number of LEDs. It may, e.g., also consist of a single LED only. In describing FIGS. 3 to 10, we will refer to a LED segment of any number of LEDs as a LED segment 10 or 20, with nodes 10T and 10B or 20T and 20B respectively.

Figure 3A:
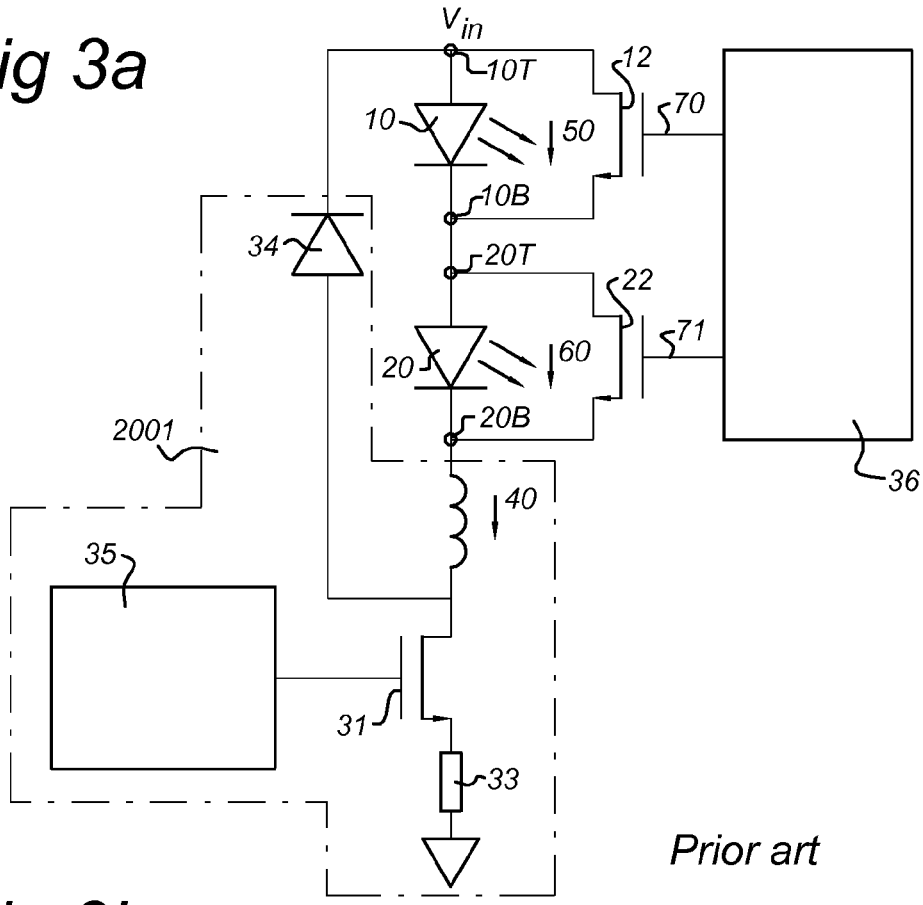
FIG. 3*a* shows a LED arrangement comprising a LED string and a driver circuit arrangement with a Buck converter according to the prior art.

FIG. 3*a* shows an embodiment of the schematic arrangement of FIG. 2. The switches 11, 21 are implemented using MOSFET transistors 12, 22. The bypass current through the top MOSFET transistor 12 from node 10T to node 10B is referred to as current 50, the bypass current through the lower MOSFET transistor 22 from note 20T to node 20B is referred to as current 60. The MOSFET transistors are depicted as NMOS transistors, but equally well be PMOS transistors or any other type of switch. The switches 12, 22 are controlled from a segment controller 36, which drives the switches with control signals 70, 71. We will refer to these control signals with the same reference numbers 70, 71 when we refer to their logical levels and when we refer to their electrical levels. The current source is implemented as a Buck converter 2001, which is built from a power switch 31, shown as a MOSFET transistor 31, an inductive element 32, a diode 34, a resistor 33 and a Buck controller 35. The Buck controller 35 drives the gate of the power transistor 31, such that the inductor is charging and discharging at a high frequency. In an example, the arrangement has a total of 36 LEDs in series in the LED string, arranged in two segments of 18 LEDs each; the converter frequency is approximately 100 kHz with a DC-input voltage Vin of 150 V, and a value of the inductor of 5 mH. In the example, the gates of the bypass switches 12, 22 are operated at a frequency of approximately 200 Hz. It is to be noted that the segment controller 36 nor the switch mode controller 35 may not be shown in subsequent figures, but they are meant to be present for controlling the switches in the segment driver units and the power switches in the power supply respectively.

Figure 3B:
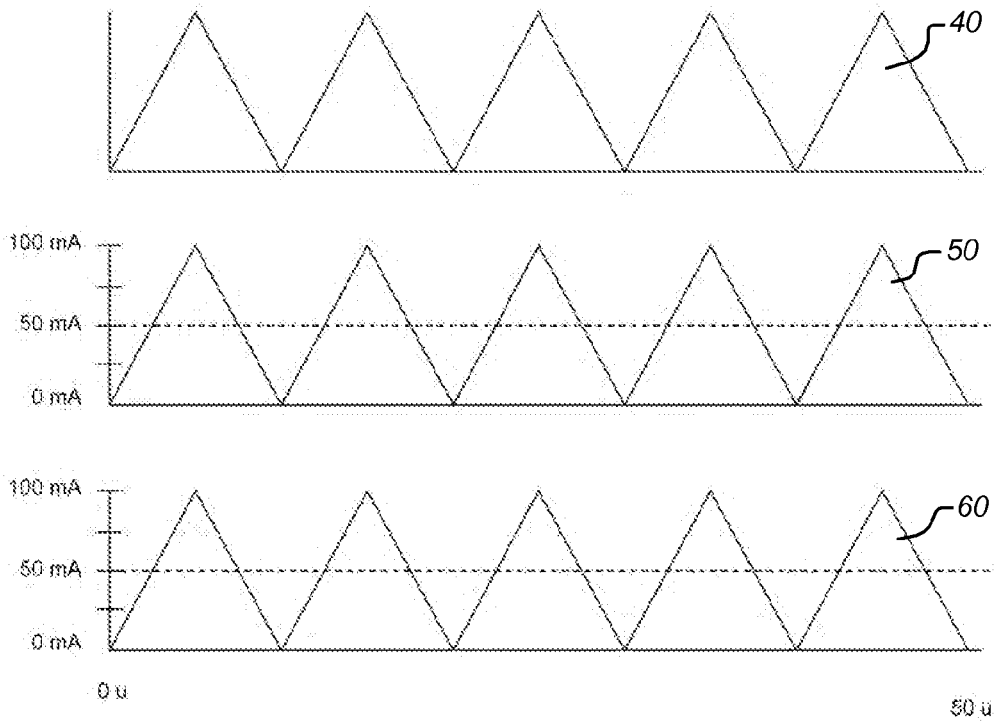
Prior art Fig 3b
FIG. 3*b* shows a simulation of the current waveforms when the LED arrangement of FIG. 3*a* is operated.

FIG. 3*b* shows the electrical waveforms at various positions in the LED arrangement of FIG. 2. The upper curve shows a coil current 40. The middle curve shows the current 50 through the upper LED segment 10. The lower curve shows the current 60 through the lower LED segment 20. The periodic modulation of the currents 40, 50, 60 is due to the operation principle of the switch mode driver, which charges and discharges the inductor 32 while periodically opening and closing the power transistor 31. The LED current waveforms 50, 60 show a very deep modulation depth, varying periodically between, in this example, 0 mA and approximately 100 mA, at an average current of about 50 mA, i.e., with peak values that are twice the nominal value. This exemplary large modulation may be used to give power-efficiency and EMI advantages because of zero-current and zero-voltage switching during switch-on of the power transistor 31.

Figure 3C:
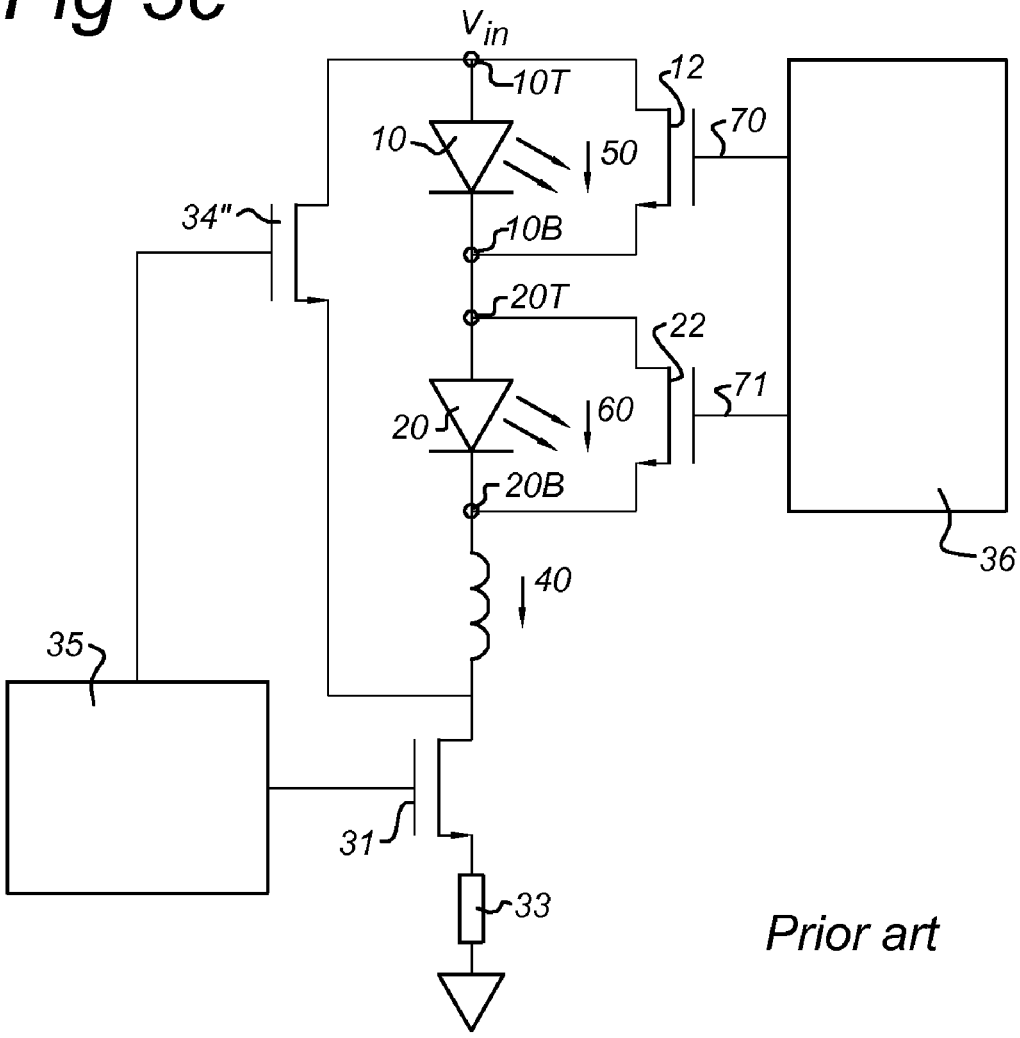
FIG. 3*c* shows an alternative arrangement to FIG. 3*a;*

FIG. 3*c* shows a similar arrangement, but with a switch 34" instead of the diode 34 of FIG. 3*b*. By opening and closing the switch depending on the phase of the operation of the switch mode driver, the switch performs a similar function as the diode: it allows the coil current to discharge.

Figure 4A:
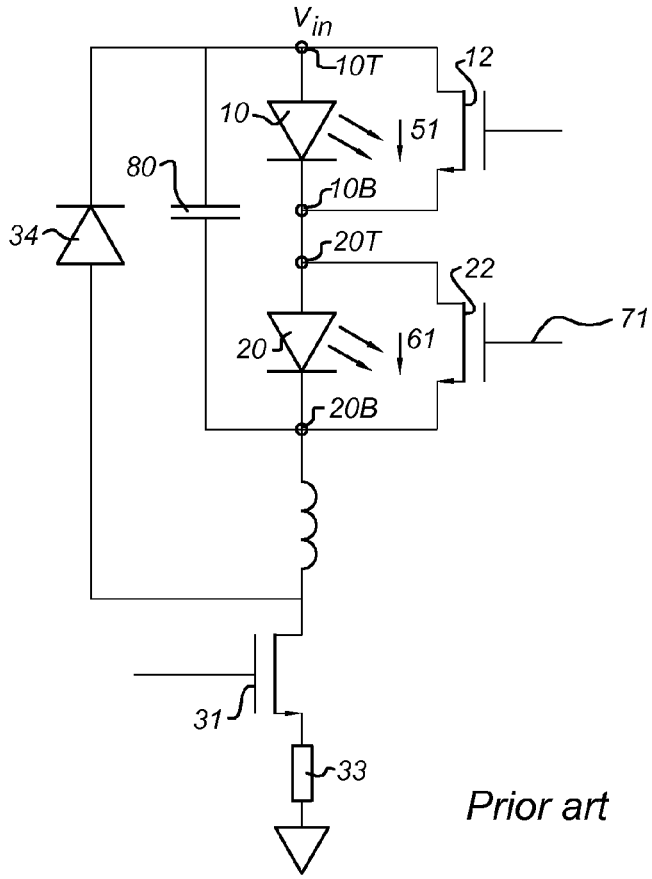
FIG. 4*a* shows a LED arrangement comprising a LED string and a driver circuit arrangement with a Buck converter with an output filter capacitor according to the prior art.

FIG. 4*a* shows an embodiment of the circuit of FIG. 2, with an added filter capacitor 80 over the output of the Buck converter. The filter capacitor 80 reduces the current modulation to a smaller modulation depth, also called ripple. In this example, the capacitor 80 has a capacitor value of 15 nF.

Figure 4B:
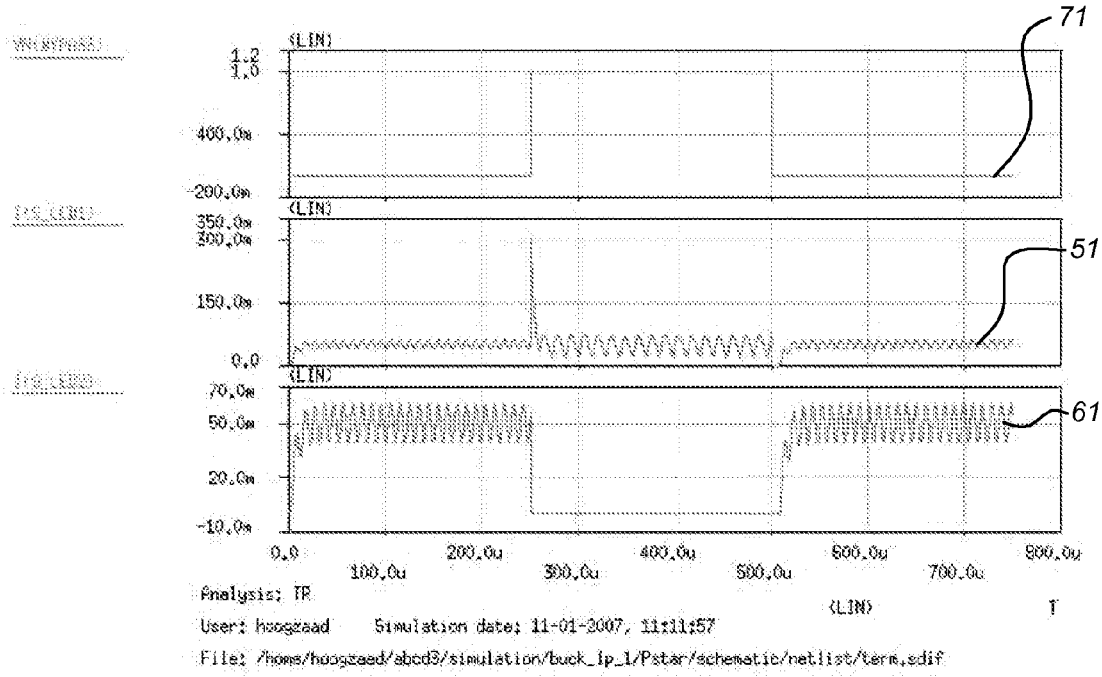
Prior art Fig 4b
FIG. 4*b* shows a simulation of the control and current waveforms when the LED arrangement of FIG. 4*a* is operated.

FIG. 4*b* shows the electrical waveforms for this example at various positions in the LED arrangement of FIG. 2. The upper curve shows a logical signal 71 controlling the gate of bypass transistor switch 22. When the logical signal 71 is high, the switch 22 is closed, such that the current flows through the switch 22 and the lower LED segment 22 is switched off. When the logical signal 71 is low, the switch 22 is open such that the current flows through the lower LED segment 22 and the lower LED segment 22 is switched on. The middle curve shows a current 51 through the upper LED segment 10. The lower curve shows a current 61 through the lower LED segment 20, which is being switched by the bypass transistor 22. It is observed that in the example the currents 51, 61 have a much smaller current modulation than the unfiltered currents 50, 60 of FIG. 3*b*, with a current ripple 51, 61 of only about 10% at a nominal LED current of about 50 mA, due to the filter capacitor 80. The maximum LED current is thus reduced with approximately 50%, resulting in a better lifetime of the LEDs compared to the unfiltered situation of FIG. 3*a* and FIG. 3*b*. However, around the switching moments, an unacceptable overshoot of about 300 mA and an undershoot of 0 mA is also observed in the LED current 51 through the upper LED 10, i.e., the LED that is not switched but continues to stay on. These high transients can damage the LEDs.

Figure 5A:
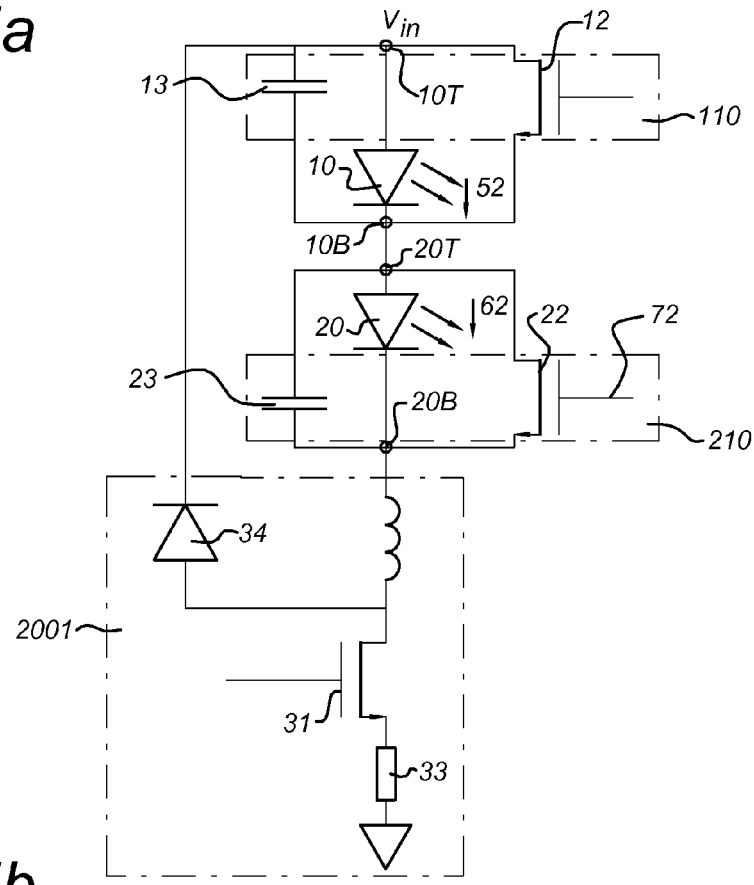
FIG. 5*a* shows a LED arrangement comprising a LED string and a driver circuit arrangement with a Buck converter according to a first embodiment of the present invention.

FIG. 5*a* shows an LED arrangement according to the present invention, with two LED segments 10, 20. Each LED segment 10, 20 is driven from a LED segment driver 110, 210 which consists of not just a switch 12, 22, but also a capacitor 13, 23 for each individual segment. The capacitors 13, 23 are connected electrically in parallel to the corresponding LED segment 10, 20, as are the switches 12, 22. I.e., the switch 12 and the capacitor 13 each connect between node 10T and 10B on either side of LED segment 10, and the switch 22 and the capacitor 23 each connect between node 20T and 20B on either side of LED segment 20. We also refer to the capacitors 13, 23 as segment capacitors. The segment capacitors 13, 23 are dimensioned such that the Buck output filter capacitor 80 is obsolete, and have a value of 30 nF each in this example, such that the same total capacitance is obtained from the series arrangement of capacitors 13 and 23 as the capacitance of capacitor 80, resulting in the same current ripple.

Figure 5B:
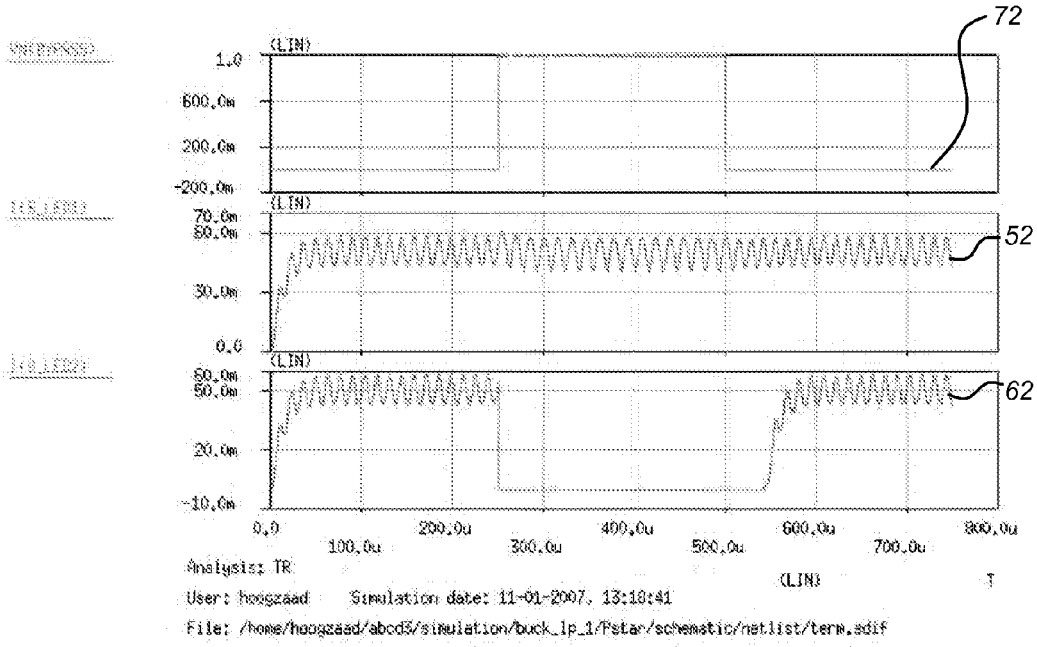
FIG. 5*b* shows a simulation of the control and current waveforms when the LED arrangement of FIG. 5*a* is operated.

FIG. 5*b* shows the electrical waveforms for this circuit. The upper curve shows a logical signal 72 controlling the gate of bypass transistor switch 22. The middle curve shows a current 52 through the upper LED segment 10. The lower curve shows a current 62 through the lower LED segment 20, which is being switched by the bypass transistor 22. Comparing currents 52, 62 of FIG. 5*b* to currents 51, 61 of FIG. 4*b*, it is clearly observed that the current over- and undershoots are removed with the segmented capacitor. Also the ripple of the current is reduced. It is also observed in the lower curve showing current 62 that the switch-on of the dimmed segment takes longer compared to the current 61 in FIG. 4*b*. This is because its segment capacitor 23 needs to charge from basically zero volt. This switch-on delay may be acceptable, as it is small compared to the drive period: in the example, the delay is about 40 μs vs. a drive period of 5 ms. When it is acceptable, the effect on the light output of the LED segment 20 can be ignored. In an alternative embodiment, the switch-on delay may be compensated for in the duty cycle of the signals 72 driving the bypass switches 12, 22. The dead time may be calibrated for the LED arrangement, or monitored and automatically compensated for. Active monitoring and correction has the advantage that temperature and ageing effects are automatically taken into account, at the cost of some additional circuitry to measure the switching time and comparing the measured time with the required duty cycle. A further embodiment with a hardware solution will be described further below.

We now turn to alternative embodiments with a Buck-boost converter employed in the driver arrangement. Compared to the previously described Buck converter, the ratio of peak LED current to average LED current can be even larger than 2 because of the discontinuous output current of a single-coil Buck-boost converter, that typically a filter capacitor is required to meet reliability and lifetime requirements of the LED. The Buck-boost topology is very well suited for the bypass driving of LEDs, as it will also continue to work well when the output voltage at any moment in time becomes smaller than the input voltage, which is the case when all bypass switches are closed and all LEDs are switched off.

An example of such a topology is disclosed and its operation is described in detail in US patent application US 2004/0145320 A1. The description uses a single-coil Buck-boost converter, but is equally applicable for other topologies such as, e.g., a 4-switch auto-up-down, a Cuk, a SEPIC or a Zeta converter, as well as isolated implementations like flyback, forward or resonant converters.

Figure 6A:
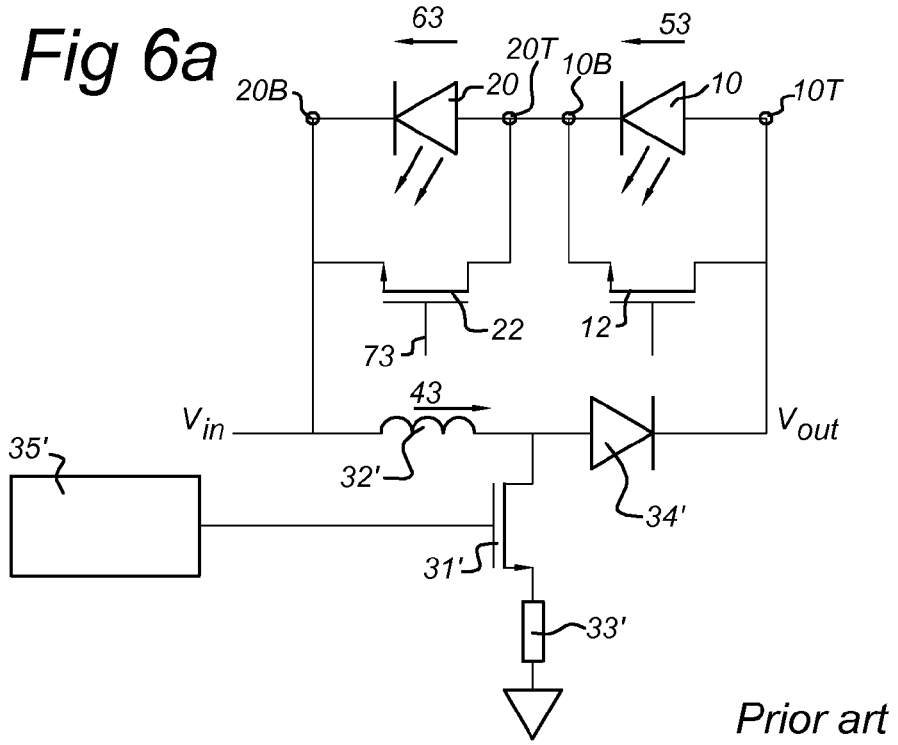
FIG. 6*a* shows a LED arrangement comprising a LED string and a driver circuit arrangement with a Buck-boost converter without an output filter capacitor according to the prior art.

FIG. 6*a* shows a LED arrangement with a Buck-boost converter according to the prior art. The Buck-boost controller has a Buck-boost controller 35', controlling the gate of a power transistor 31', an inductive element 32', a diode 34' and a resistor 33'.

Figure 6B:
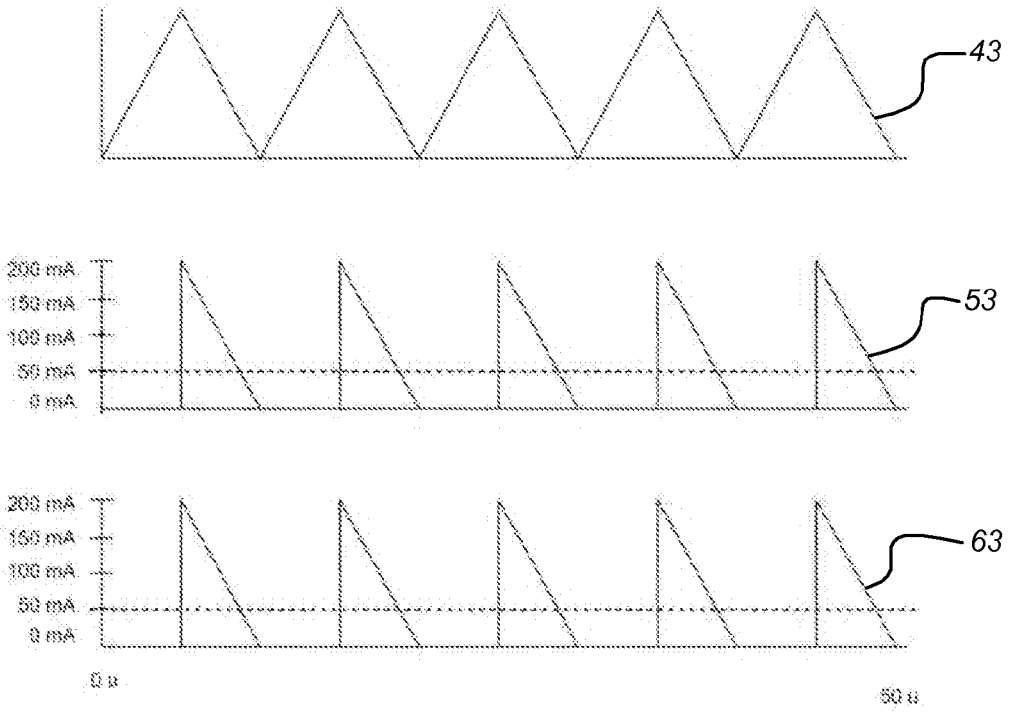
Prior art Fig 6b
FIG. 6*b* shows a simulation of the current waveforms when the LED arrangement of FIG. 6*a* is operated.

FIG. 6*b* shows a simulation of the electrical behaviour for an example with a converter frequency of again approximately 100 kHz, Vin=24 V and a total of 22 LEDs is placed in series in the LED string, arranged in two segments of 11 LEDs each. In the example, the inductive element 32' with an inductor value of 500 μH. The coil current 43 shows a continuous triangular behavior. The LED currents 53, 54 however show a discontinuous saw-tooth behavior in which the LEDs carry a current during the secondary stroke of each supply conversion period when the inductive element 32' is discharging over the diode 34' and delivering a current to the LED string. In this example, for an average LED current of about 50 mA, the peak LED current is about 200 mA.

Figure 7A:
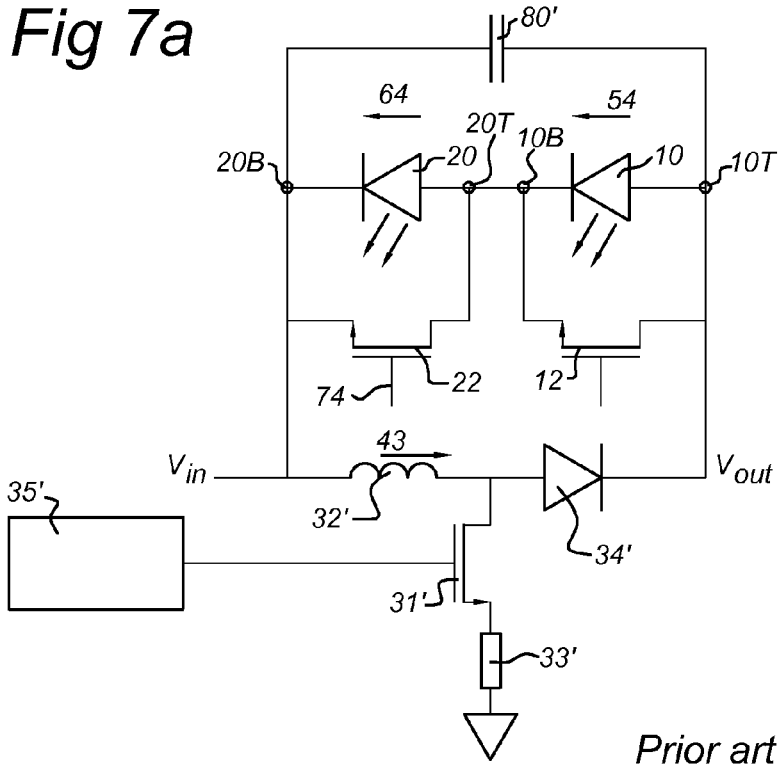
FIG. 7*a* shows a LED arrangement comprising a LED string and a driver circuit arrangement with a Buck-boost converter with an output filter capacitor according to the prior art.

FIG. 7*a* shows a LED arrangement with a Buck-boost converter with an output filetr capacitor according to the prior art. The Buck-boost controller has a Buck-boost controller 35', controlling the gate of a power transistor 31', an inductive element 32', a diode 34' and a resistor 33', as in FIG. 6*a*. A capacitor 80' is placed over the converter in parallel to the LED string. This capacitor filters the discontinuous current with the large amplitude shown in FIG. 6*b* to a current with a reduced ripple. In this example, the resulting ripple is about 10%. In this example, the inductive element 32' has an inductor value of 500 μH, the converter output filter capacitor 80' has a capacitor value of 150 nF, the converter frequency is again approximately 100 kHz, Vin=24 V and a total of 22 LEDs is placed in series in the LED string, arranged in two segments of 11 LEDs each.

Figure 7B:
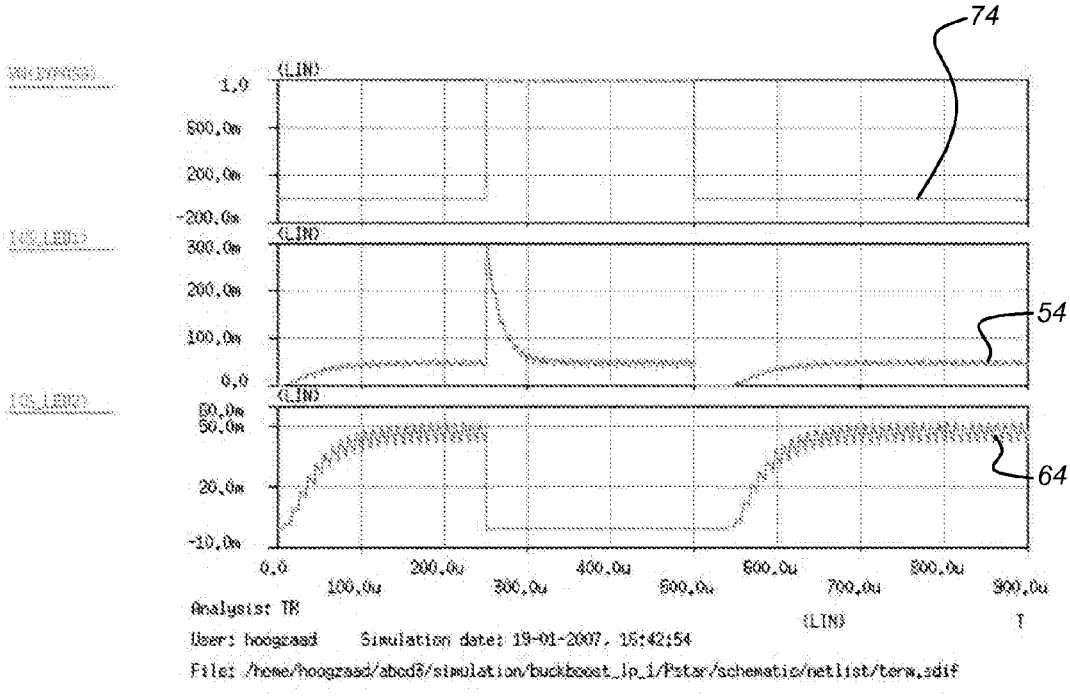
Prior art Fig 7b
FIG. 7*b* shows a simulation of the control and current waveforms when the LED arrangement of FIG. 7*a* is operated.

FIG. 7*b* shows a simulation of the electrical behavior. The upper curve shows a logical signal 74 controlling the gate of bypass transistor switch 22. The middle curve shows a current 54 through the right LED segment 10. The lower curve shows a current 64 through the left LED segment 20, which is being switched by the bypass transistor 22. Again, severe over- and undershooting LED currents are observed of approximately 300 mA and 0 mA at a nominal LED current of 50 mA in this example. The electrical components are dimensioned to get a current ripple of approximately 10%, as in the Buck-converter case. The discontinuous output of the Buck-boost converter required an increased amount of filtering, resulting in a somewhat longer rise time of current 64, compared to the rise time of current 61 of the Buck converter of FIG. 5*b*.

Figure 8A:
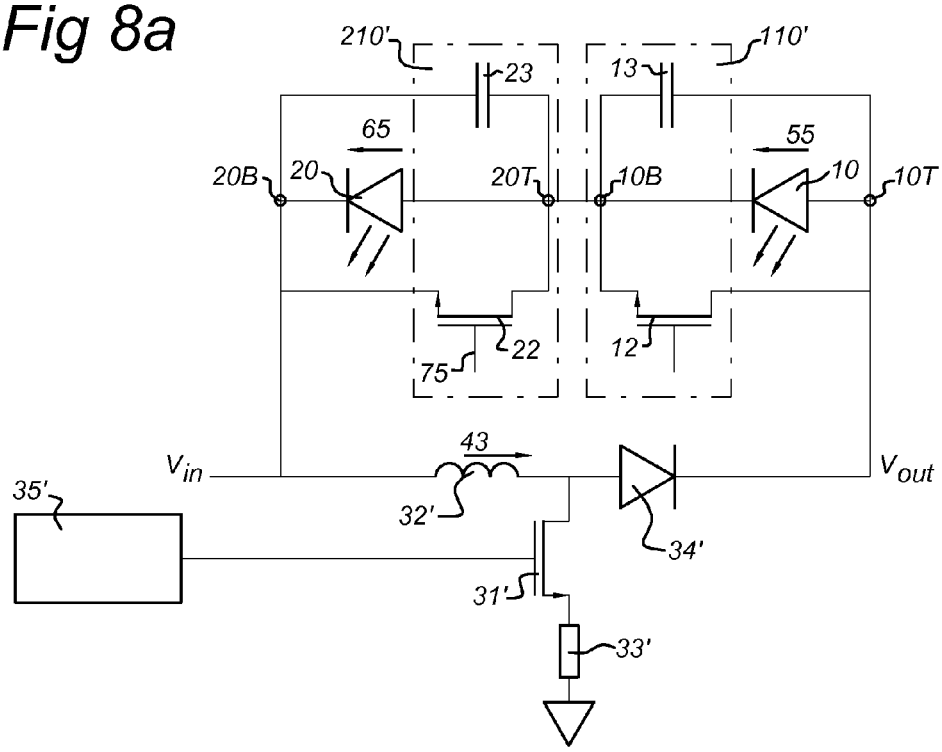
FIG. 8*a* shows a LED arrangement comprising a LED string and a driver circuit arrangement with a Buck-boost converter according to a second embodiment of the present invention.

FIG. 8*a* shows a LED arrangement with a Buck-boost converter according to the invention. Comparing FIG. 8*a* to FIG. 7*a*, the Buck-boost converter output filter capacitor 80' of FIG. 7*a* is omitted and a first capacitor 13, 23 is applied for each of the LED segments. The first capacitors 13, 23 are connected electrically in parallel to the corresponding LED segment 10, 20, as are the switches 12, 22. I.e., the switch 12 and the capacitor 13 each connect between node 10T and 10B on either side of LED segment 10, and the switch 13 and the capacitor 23 each connect between node 20T and 20B on either side of LED segment 20.

Figure 8B:
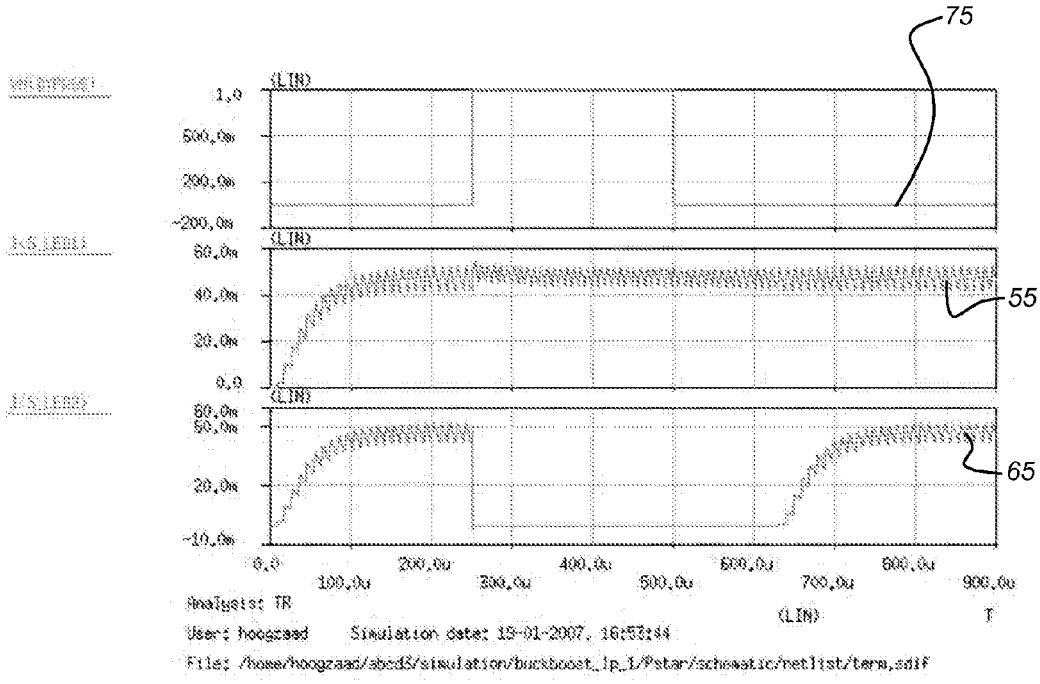
FIG. 8*b* shows a simulation of the control and current waveforms when the LED arrangement of FIG. 8*a* is operated.

As an example, FIG. 8*b* shows a simulation of the currents through the LEDs for a value of each of the first capacitors, of 300 nF, the filter capacitor is functionally replaced by serially connected first capacitors of the segments. The upper curve shows a logical signal 75 controlling the gate of bypass transistor switch 22. The middle curve shows a current 55 through the right LED segment 10. The lower curve shows a current 65 through the left LED segment 20, which is being switched by the bypass transistor 22. A larger switch-on delay for current 65 is observed, compared to the switch-on delay for the current 62 of the Buck converter of FIG. 5*b*, due to the increased amount of filtering for the same current ripple of about 10%. This switch-on delay can be compensated for in the timing of the bypass switches, as described above in the discussion of FIG. 5. An alternative solution to prevent switch-on delay and to prevent the slow rise time is described next.

Figure 9A:
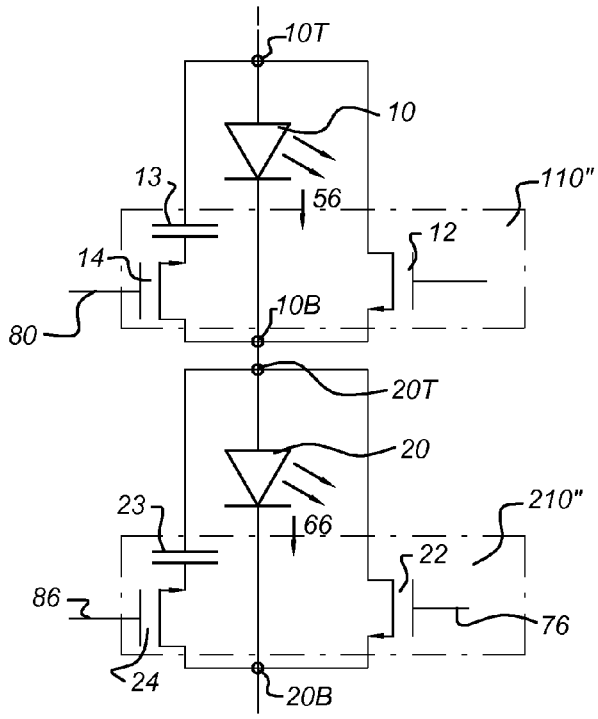
FIG. 9*a* shows a LED arrangement comprising a LED string and a driver circuit arrangement with a Buck-boost converter according to a third embodiment of the present invention.

FIG. 9*a* shows two LED segment drivers 110", 210" for two LED segments 10, 20 according to a further embodiment of the invention. The segment driver comprises a bypass switch 12, 22 and a segmented capacitor 13, 23, and is also equipped with a second switch 14, 24 in series with the segmented capacitor 13, 23. The series arrangement of the capacitor 13, 23 and corresponding second switch 14, 24 is connected electrically in parallel to the corresponding LED segment 10, 20, as is the bypass switches 12, 22. I.e., the series arrangement of the second switch 14 and the capacitor 13 connects between node 10T and 10B on either side of LED segment 10, as does the bypass switch 12. Likewise, the series arrangement of the second switch 24 and the capacitor 23 connects between node 20T and 20B on either side of LED segment 20, as does the bypass switch 22. The second switch and the segmented capacitor are operated to hold the voltage across the LED for the next switch-on phase after the LED is switched off. We thus also refer to the second switch and segmented capacitor as sample-and-hold switch and hold capacitor.

Figure 9B:
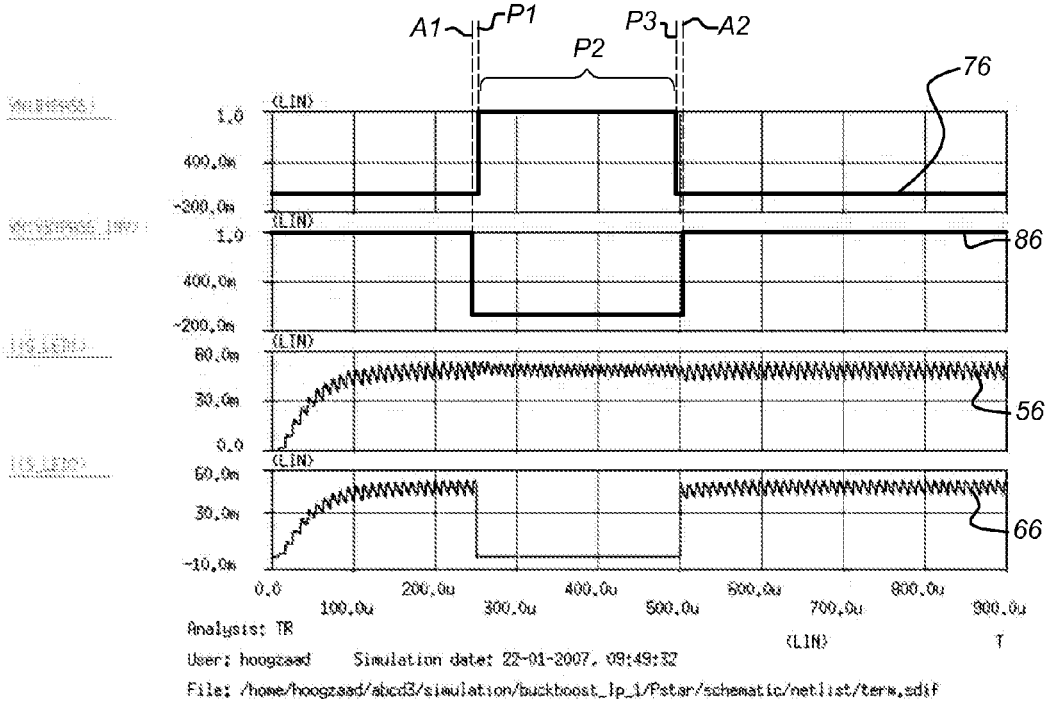
FIG. 9*b* shows a simulation of the control and current waveforms when the LED arrangement of FIG. 9*a* is operated.

FIG. 9*b* shows the electrical behavior of a logical signal 76 controlling the gate of bypass transistor switch 22, a logical signal 86 controlling the gate of sample-and-hold transistor switch 23, a current 56 through the upper LED segment 10 and a current 66 through the lower LED segment 20, when the circuit of FIG. 9*a* is implemented with the Buck-boost supply topology of FIG. 8*a*. The simulation is done without any compensation in the control signals of the bypass switches 12, 22. A fast and instantaneous switch-on of the current 66 is observed.

To prevent short-circuiting of the segmented capacitor 13, 23 and sample-and-hold switch 14, 24 with the bypass switch 12, 22, a non-overlapping clocking scheme is used, in which in a first phase A1, the voltage across LEDs is sampled by opening (i.e., put in a non-conducting state) the sample-and-hold switch 14, 24 and hold the voltage on the capacitor 13, 23; secondly, in a second phase P1 bypass switch 12, 22 is closed (i.e., put in conducting state) to switch off the corresponding LED segment 10, 20; in a third phase P2, the bypass switch 12, 22 is kept closed for a certain PWM period; in a fourth phase P3, the bypass switch 12, 22 is opened (i.e., put in a non-conducting state) to switch on the corresponding LED segment 10, 20; and in a fifth phase A2, the filter and sample capacitor is connected again across corresponding LED segment 10, 20 by closing the sample-and-hold switch 14, 24.

Figure 9C:
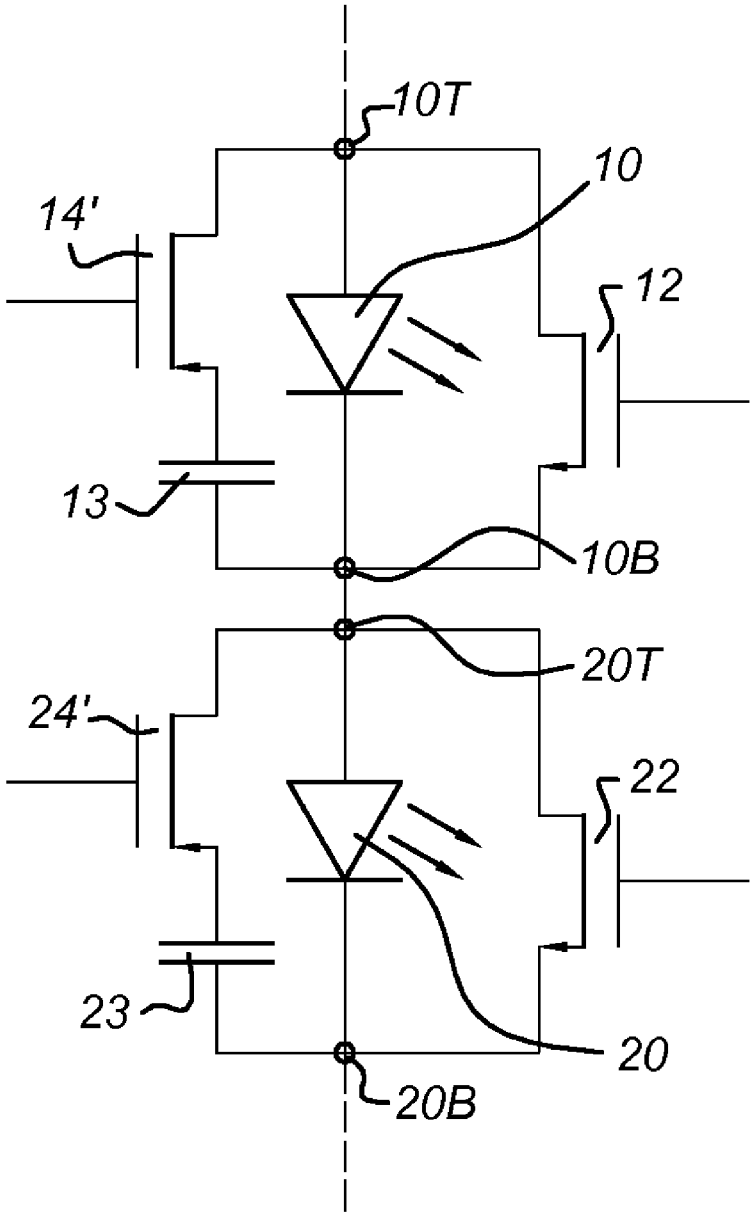
FIG. 9*c* shows another LED arrangement according to an embodiment of the present invention.

FIG. 9*c* shows an alternative embodiment, with a pMOS transistor 14', 24' at the upper side of the segmented capacitor 13, 23. This alternative embodiment is operated in a similar to that shown in FIG. 9*a*, as a person skilled in the art will understand.

Figure 10:
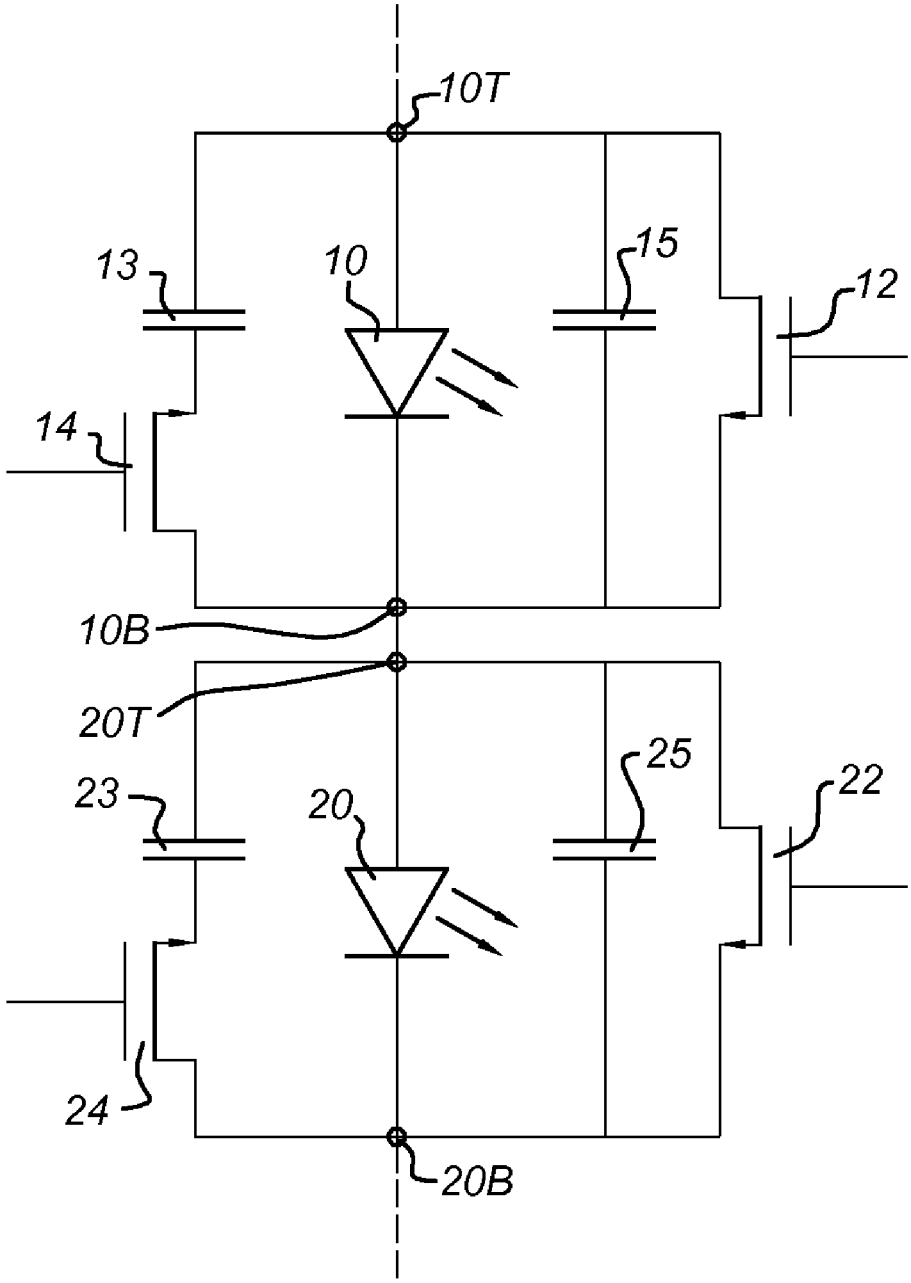
FIG. 10 shows a LED arrangement comprising a LED string and a driver circuit arrangement with a Buck-boost converter according to a fourth embodiment of the present invention.

During the small disconnect time of the segment capacitor the LED current gets filtered only by the parasitic capacitors of the LED itself. This disconnect time largely depends on the speed of the available devices in the IC process that is used to implement the drivers for the switches and consequently—it may be beneficial to add an additional (second) capacitor which is not sampled to the segment driver units of FIG. 9*a* or 9*c*. This is depicted in FIG. 10 with capacitors 15, 25. As an example, the capacitors 15, 25 may each have a value of 1 nF, an order of magnitude smaller than the first capacitor. The capacitor 15, 25 is connected electrically in parallel to the corresponding LED segment 10, 20. I.e., also capacitor 15 connects between node 10T and 10B on either side of LED segment 10, and also capacitor 25 connects between node 20T and 20B on either side of LED segment 20.

In the description of the invention and its embodiments above, the physical arrangement of all components was not explicitly discussed. The arrangement may be built from discrete components on a single or on a plurality of carriers, e.g., printed circuit boards. The invention and its embodiments can be advantageously applied when the arrangement can be built from modular components with one or more of its specific components integrated in an assembly for each individual LED segment, or alternatively in an assembly for several LED segments together. In some embodiments, the assemblies are constructed on small printed circuit boards (PCBs) as small LED modules, each carrying all the LEDs for a single LED segment and one or more of the specific components needed in an arrangement according to the invention. Depending on the required size of the assembly for a specific application, the number of modules is then easily adapted. In some embodiments, the assembly is constructed on a submount, e.g., a silicon or ceramic carrier, and the assembly thus forms an active LED package.

A LED assembly according to one embodiment of the invention comprises a LED 10 and a capacitor 13. The capacitor 13 is arranged electrically in parallel to the LED 10.

Figure 11:
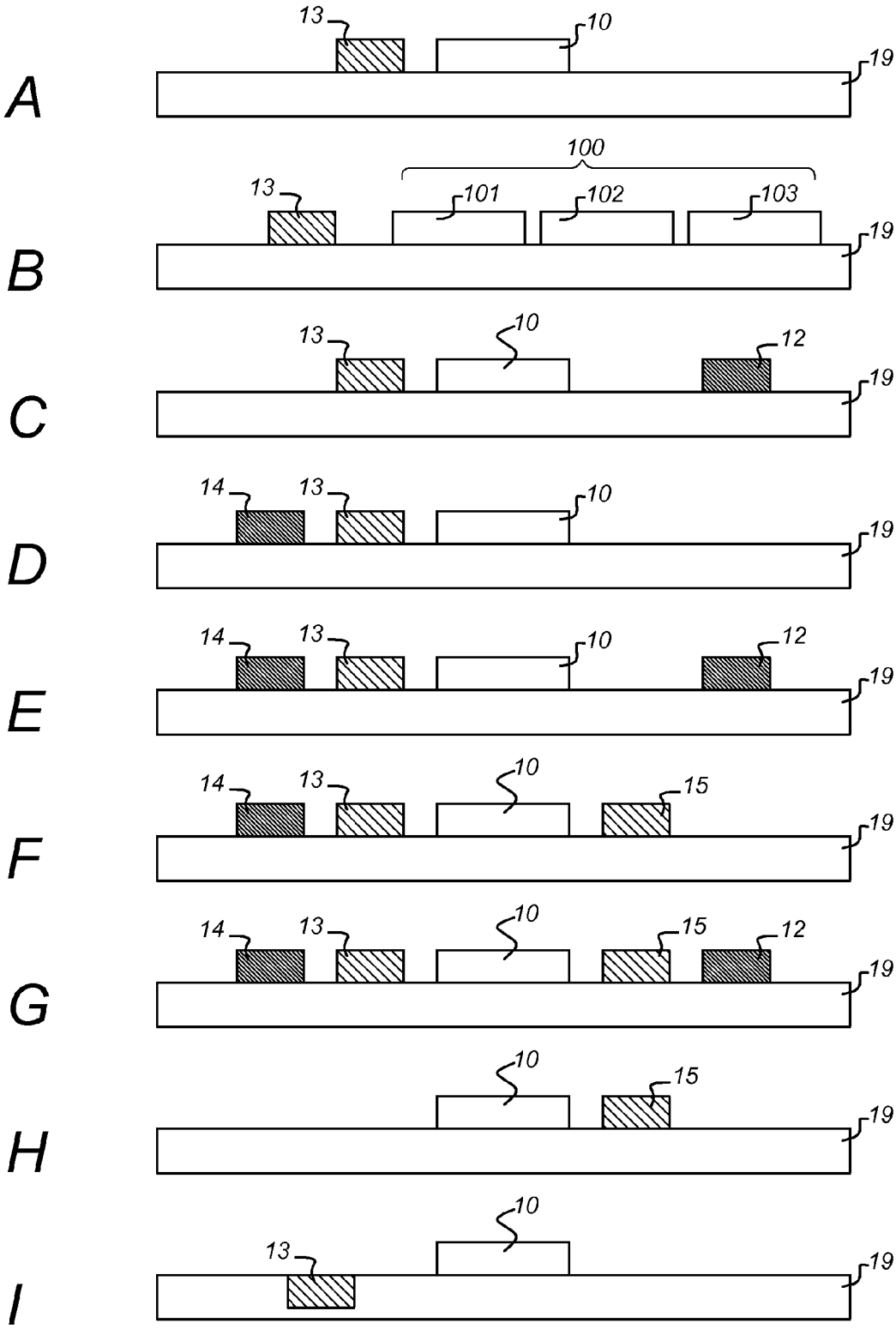
FIG. 11*a*-11*i* show LED assemblies according to the invention.

A plurality of these assemblies can be easily put together with external switches and an external power supply to create the LED arrangement of e.g., FIG. 7. Alternatively, a plurality of these assemblies can be put together to form a ladder network of LEDs and capacitors. This ladder network may then be connected to a plurality of external switches and an external power supply to create the LED arrangement of e.g., FIG. 7. FIG. 11*a* shows such a LED assembly, where the LED 10 and the capacitor 13 are mounted on a carrier 19.

FIG. 11*b* shows an alternative LED assembly where three LEDs 101, 102, 103 are mounted in a series arrangement as one LED segment 100, together with a capacitor 13, on a carrier.

FIG. 11*c* shows another alternative LED assembly where a LED 10 (or a series arrangement 100 of LEDs 101, 102, 103 as in FIG. 11*b*), a first capacitor 13 and a bypass switch 12 are mounted on a carrier 19. The bypass switch 12 is connected electrically parallel to the LED 10 or LED segment 100 of several LEDs in series 101, 102, 103.

FIG. 11*d* shows again another alternative LED assembly where a LED 10 (or a series arrangement 100 of LEDs 101, 102, 103 as in FIG. 11*b*), a first capacitor 13 and a sample-and-hold switch 14 are mounted on a carrier 19. The sample-and-hold switch 14 is connected electrically in series with the first capacitor 13, and together these are arranged electrically parallel to the LED 10 or LED segment 100 of several LEDs in series 101, 102, 103.

FIG. 11*e* shows again another alternative LED assembly where a LED 10, a first capacitor 13, a sample-and-hold switch 14 and a bypass switch 12 are mounted on a carrier 19. The sample-and-hold switch 14 is connected electrically in series with the first capacitor 13, and together these are arranged electrically parallel to the LED 10 and to the bypass switch 12.

FIG. 11*f* shows again another alternative LED assembly where a LED 10 (or a series arrangement 100 of LEDs 101, 102, 103 as in FIG. 11*b*), a first capacitor 13, a sample-and-hold switch 14 and a second capacitor 15 are mounted on a carrier 19. The sample-and-hold switch 14 is connected electrically in series with the first capacitor 13, and together these are arranged electrically parallel to the LED 10 and the second capacitor 15.

FIG. 11*g* shows again another alternative LED assembly where a LED 10 (or a series arrangement 100 of LEDs 101, 102, 103 as in FIG. 11*b*), a first capacitor 13, a sample-and-hold switch 14, a bypass switch 12 and a second capacitor 15 are mounted on a carrier 19. The sample-and-hold switch 14 is connected electrically in series with the first capacitor 13, and together these are arranged electrically parallel to the LED 10, to the bypass switch 12, and to the second capacitor 15. The switches 12 and 15 may be discrete switches, or integrated as part of an IC that also contains the driving electronics for the switch.

FIG. 11*h* shows again another alternative LED assembly where a LED 10 (or a series arrangement 100 of LEDs 101, 102, 103 as in FIG. 11*b*) and the second capacitor 15 are mounted on a carrier 19. The second capacitor 15 is arranged electrically parallel to the LED 10.

FIG. 11*i* shows a LED assembly, where one LED 10 (or a series arrangement 100 of LEDs 101, 102, 103 as in FIG. 11*b*) and one capacitor 13 are carried by a silicon submount carrier 19. More specifically, the capacitor is implemented in the silicon submount itself instead of mounted as a separate electrical component on its surface. A plurality of these assemblies can be easily put together with external switches, external capacitors and an external power supply to create the LED assembly of, e.g., FIG. 7. Also, additional electrical components, such as the sample-and-hold switches or capacitors may be integrated in the submount.

Figure 12:
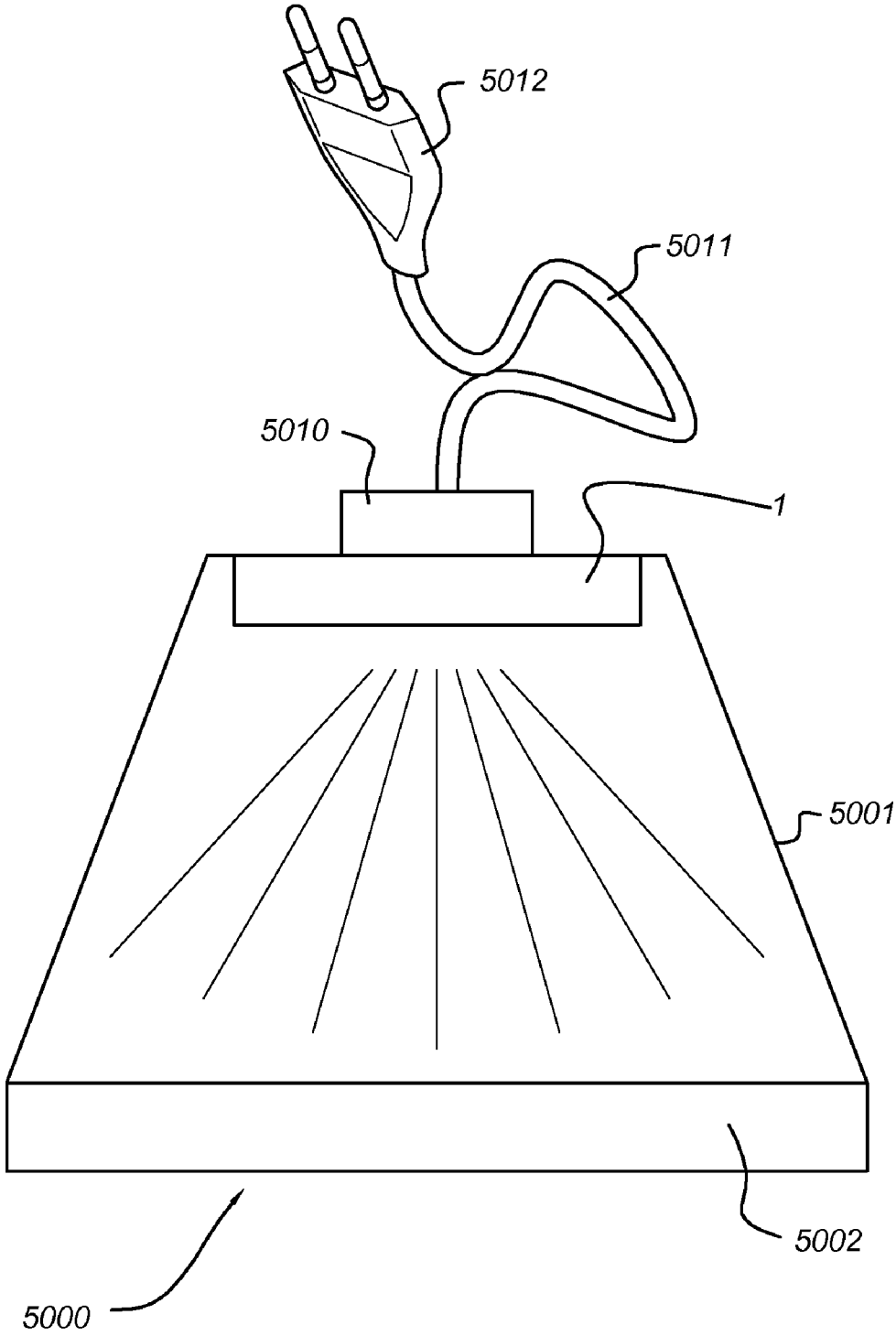
FIG. 12 shows an illumination system according to the invention.

FIG. 12 shows a light source 5000 with a LED assembly 1 in a housing 5001. The housing 5001 is a metal box with reflective inner walls. The light generated by the LED assembly is reflected towards the front of the housing, which is covered with a diffusive transparent plate 5002. The light source 5000 carries a power adapter 5010, which supplies the LED assembly 1 with an input voltage Vin from an AC/DC converter, connected to the mains via a power cord 5011 with a power connecter 5012, to fit a wall contact (not shown) with mains supply.

Figure 13:
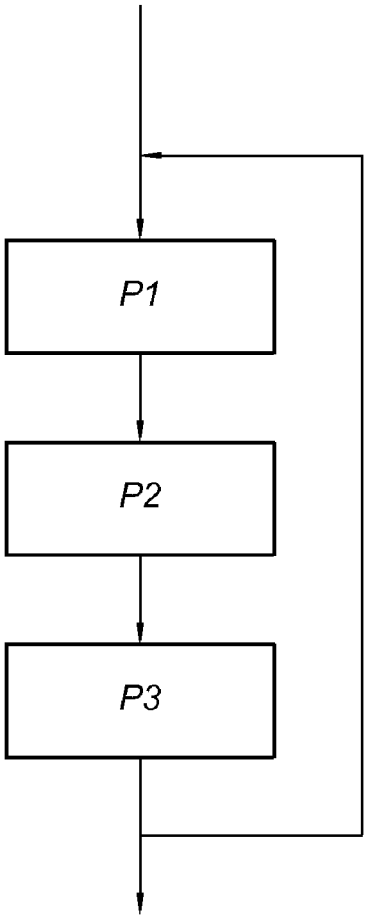
FIG. 13 shows a method according to the invention.

FIG. 13 shows a method according to the invention to operate a LED arrangement according to the invention, e.g., the LED arrangement shown in FIG. 5*a*. The method comprises periodically executing a period comprising at least three subsequent phases P1, P2, P3. The first phase Pl, comprises closing the first switching element 12, 22 such that the current through the LED segment 10, 20 stops and the LED segment 10, 20 is switched off The subsequent second phase P2 comprises keeping the first switching element 12, 22 closed for a specific duration of time for each individual drive period. The subsequent third phase P3 comprises opening the first switching element 12, 22 such that the current flows through the LED segment 10, 20 and the LED segment 10, 20 is switched on.

In an example, the period has a duration of 5 ms, corresponding to a frequency of 200 Hz. A current of 100 mA runs through the LED string and is routed by the first switching element 12 through the LED segment 10 such that the LED segment 10 emits light. At phase P1 at the beginning of the period, the first switching element 12 closes and the current is routed through the first switching element 12, bypassing the LED segment 10, such that the LED segment 10 switches off The first switching element 12 remains closed during second phase P2, with a specific duration of time of, e.g., 2 ms. After this specific duration, during the third phase P3 of the method the first switching element 12 opens again and the LED segment 10 is switched on for the remainder of the period and until the first phase P1 of the next period starts. By varying the specific duration of time in each individual drive period, the time that the LED segment 10 emits light is varied and the amount of light emitted (averaged) over the drive period is varied. When the specific duration has the same duration as the drive period, the LED segment remains off.

Second phase P2 may comprise applying a compensation to the specific time for each individual drive period, the compensation compensating for the switching delay of the corresponding segment driver unit 110, 210. As shown in, e.g., FIG. 5*b* and FIG. 8*b*, a switching delay can occur when switching on a LED segment 10, 20. In the examples shown in FIG. 5*b* and FIG. 8*b*, these delays are about 40 resp. 150 μs. This delay can be compensated for in the specific duration of time that the first switching element remains closed in P3.

Figure 14:
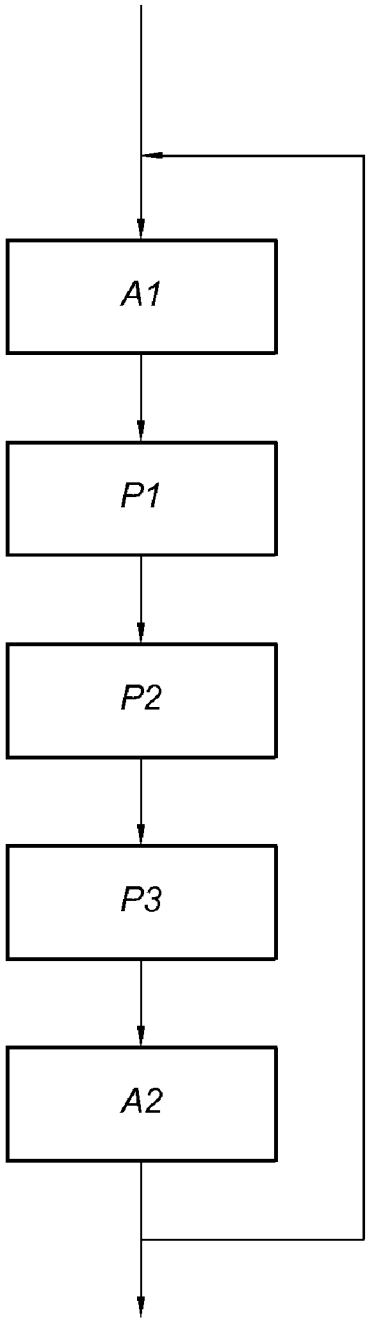
FIG. 14 shows a further method according to the invention.

FIG. 14 shows a further method according to the invention, to operate a LED arrangement according to the invention, e.g., the LED arrangement with the segment driver units 110", 210" shown in FIG. 9*a*. In the LED arrangement to which this method applies, each segment driver unit 110", 210" comprises also a second switching element 14, 24, arranged electrically in series with the first capacitor 13, 23.

The method comprises periodically executing a period comprising the at least three subsequent phases P1, P2, P3, and a first auxiliary phase A1 prior to the first phase and a second auxiliary phase A2 after the third phase. The first auxiliary phase A1 comprises opening the second switching element 14, 24 such that the voltage over the corresponding LED segment 10, 20 is held by the first capacitor 13, 23. The subsequent first phase P1 comprises closing the first switching element 14, 24 such that the current through the LED segment 10, 20 stops and the LED segment 10, 20 is switched off. The subsequent second phase P2 comprises keeping the first switching element 12, 22 closed for a specific duration of time. The subsequent third phase P3 comprises opening the first switching element 12, 22 such that the current flows through the LED segment 10, 20 and the LED segment 10, 20 is switched on again. Last, the second auxiliary phase A2 comprises closing the second switching element 14, 24.

It should be noted that the above-mentioned embodiments illustrate rather than limit the invention, and that those skilled in the art will be able to design many alternative embodiments without departing from the scope of the appended claims. E.g., other topologies can be used for the switched-mode power supply, the diode 34, 34' can be replaced by a switch 34", p-type as well as n-type switches can be used, and other types of switches can be used, such as an IGBT instead of a MOSFET, without departing from the scope of the invention and the appended claims. In the claims, any reference signs placed between parentheses shall not be construed as limiting the claim.

The invention claimed is:

1. A LED arrangement comprising a LED string and a driver circuit arrangement, the LED string comprising at least two LED segments, the at least two LED segments arranged electrically in series, each LED segment comprising at least one LED, the driver circuit arrangement comprising a segment driver unit for each LED segment, each segment driver unit comprising a first switching element arranged electrically parallel with the corresponding LED segment for controlling, during use, of a current through the LED segment, characterized in that each segment driver unit comprises a first capacitor, the first capacitor being arranged electrically in parallel with at least one of the LEDs of the corresponding LED segment.

2. LED arrangement according to claim 1, wherein the driver circuit arrangement comprises a segment controller, the segment controller being arranged for generating a first control signal for each segment driver unit, the first control signal driving the first switching element of the corresponding segment driver unit.

3. LED arrangement according to claim 1 wherein each segment driver unit comprises a second switching element, the second switching element being arranged electrically in series with the first capacitor.

4. LED arrangement according to claim 3, wherein each segment driver unit comprises a second capacitor, the second capacitor being arranged electrically in parallel with the at least one of the LEDs of the corresponding LED segment.

5. LED arrangement according to claim 1, further comprising a power supply arranged for supplying a supply current, during use, to the LED string, the supply current being substantially independent of the number of LEDs that are switched on and off at any moment in time.

6. LED arrangement according to claim 5, wherein the power supply comprises a switched-mode controller, a third switching element, an inductive element and a component selected from the group of a diode and a fourth switching element, wherein the switched-mode controller is arranged for operating the third switching element in order to charge and discharge the inductive element, wherein the inductive element is discharged via the component selected from the group of a diode and a fourth switching element.

7. An illumination system comprising a LED arrangement according to claim 1.

8. A method for controlling a LED arrangement having a LED string and a driver circuit arrangement, the method comprising:

providing the LED string with at least two LED segments arranged electrically in series, wherein each LED segment includes at least one LED, and the driver circuit arrangement includes a segment driver unit for each of the at least two LED segments;

providing each segment driver unit with a first switching element arranged electrically parallel with the corresponding LED segment for controlling, during use, of a current through the LED segment, and a first capacitor arranged electrically in parallel with at least one of the LEDs of the corresponding LED segment; and controlling the LED segments through the segment driver units.

9. The method according to claim 8, further comprising:

generating a first control signal for each segment driver unit, the first control signal driving the first switching element of the corresponding segment driver unit, executing a drive'period, repeating the drive period periodically, each drive period comprising at least three subsequent phases, in the first phase, closing the first switching element such that the current through the LED segment stops and the LED segment is switched off, in the second phase, keeping the first switching element closed for a specific duration of time for each individual drive period, in the third phase, opening the first switching element such that the current flows through the LED segment and the LED segment is switched on.

10. The method according to claim 9, further comprising:

applying a timing compensation for each individual drive period, the timing compensation compensating for the switching delay of the corresponding segment driver unit.

11. The method according to claim 10 wherein each segment driver unit further comprises a second switching element, the second switching element being arranged electrically in series with the first capacitor, and the method further comprising:

generating a second control signal for each segment driver unit, the second control signal driving the second switching element of the corresponding segment driver unit, periodically executing a drive period having a first auxiliary phase prior to a first phase and a second auxiliary phase after a third phase, in the first auxiliary phase, opening the second switching element such that a the voltage over the corresponding LED segment is held by the first capacitor, in the second auxiliary phase, closing the second switching element.

12. A light emitting diode (LED) assembly comprising at least one LED die and a first capacitor, the first capacitor being arranged electrically in parallel to the at least one LED die;

a carrier, the carrier carrying the at least one LED die and the first capacitor; and a bypass switching element, wherein the carrier carries the bypass switching element, and the bypass switching element is arranged electrically in parallel to the at least one LED die.

13. Light emitting diode (LED) assembly according to claim 12, wherein the carrier is a sub-mount or a printed circuit board (PCB).

14. Light emitting diode (LED) assembly according to claim 12, comprising a sample-and-hold switching element, wherein the carrier carries the sample-and-hold switching element, and the sample-and-hold switching element is arranged electrically in series with the first capacitor.

15. Light emitting diode (LED) assembly according to claim 12 comprising a second capacitor, wherein the carrier carries the second capacitor, and the second capacitor is arranged electrically in parallel to the at least one LED die.

16. A LED arrangement comprising a LED string and a driver circuit arrangement, the LED arrangement comprising at least two LED assemblies according to claim 12 and a power supply.

* * * * *